US005400128A

United States Patent [19]

Michlin

[11] Patent Number: 5,400,128

[45] Date of Patent: Mar. 21, 1995

[54] WIPER AND SPREADER BLADES WITH CONDUCTIVE COATING

[76] Inventor: Steven B. Michlin, 5310 Bentley Suite 105, West Bloomfield, Mich. 48322

[21] Appl. No.: 101,016

[22] Filed: Aug. 3, 1993

Related U.S. Application Data

[62] Division of Ser. No. 883,698, May 13, 1992, Pat. No. 5,237,375.

[51] Int. Cl.[6] ..... G03G 21/00

[52] U.S. Cl. ..... 355/299; 355/296; 355/219

[58] Field of Search ..... 355/299, 246, 245, 259, 355/261, 219, 296

[56] References Cited

U.S. PATENT DOCUMENTS

| | | | |
|---|---|---|---|
| 4,240,739 | 12/1980 | Koumura et al. . | |
| 4,937,633 | 6/1990 | Ewing | 355/299 |
| 5,107,563 | 4/1992 | Zimmerman et al. | 15/250.36 |
| 5,126,913 | 6/1992 | Araya et al. | 355/219 |

FOREIGN PATENT DOCUMENTS 62-208081 9/1987 Japan .

*Primary Examiner*—R. L. Moses

[57] ABSTRACT

In toner cartridge assemblies for use in copiers, printers and facsimile machines, a conductive coating is applied to the wiper and spreader blades. The wiper blade removes excess toner from the photo-sensitive photoreceptor drum and the spreader blade controls and adjusts the quantity of toner on the developing cylinder. The conductive coating is applied over the surfaces of the wiper and spreader blades which contact the drum and developing cylinder, respectively. The coating comprises polytetrafluoroethylene (TEFLON) made conductive by the addition of a conductive substance. The conductive coating reduces friction, minimizes toner attachment, and reduces warpage of the blades. The conductive coating eliminates static electricity within the cartridge assembly and, in the case of the wiper blade, eliminates the need for an erase lamp by providing a charge path away from the drum if the blade is grounded.

4 Claims, 5 Drawing Sheets

Cross-Sectional View of the Image Formation System

WIPER AND SPREADER BLADES WITH CONDUCTIVE COATING

This application is a Division of Ser. No. 07/883,698, filed May 13, 1992, now U.S. Pat. No. 5,237,375, issued on Aug. 17, 1993.

BACKGROUND AND SUMMARY

This invention relates to a device for the improvement of a little known imperfection in state of the art technology, which incorporates the use of dry toner devices, such as copiers, facsimile machines, laser printers and toner cartridge assemblies that are now possible to recharge when empty, rather than purchase a completely new assembly containing all new parts. Until recently, service on plain-paper copy machines, facsimile machines, and printers was very costly, which cost can now be substantially reduced because the wear parts are kept in a removable cartridge. While at the same time extending the life expectancy of the toner cartridge now, increased utility and productivity may now be achieved. This new technology is applicable to be used on component #C1, as well as component #C2, each of which will be slightly modified, to improve heat dissipation from generated heat during machine usage and at the same time will function, control and limit potential non-uniform distribution of toner during machine operation. Therefore, although the problems above mentioned were known, the solution was very obscure until the wear and generated heat resulting from machine operation, particularly the frictional heat from the blade doing the job, was characterized as being the problem. It was not readily resolved, because at the time the machine was being operated, it was at an elevated temperature, while component inspection was made at a time when the machine (and cartridge) was cold, since the disassembly inspection time permitted said components to cool, and when said machine operated, said components return again to elevated temperature state. This possibly explains why the solution the above problems were not previously recognized.

Accordingly, having recognized the problem and its solution, it is a primary object of this invention to modify components #C1 and #C2 respectively, in a reusable toner cartridge, while at the same time installing improved replacements for the defective components without the necessity of purchasing a completely new cartridge, as in the past. The same enhancements as above may be made in machines that don't use toner cartridges, as well as other machines of different design.

Another object of the invention is to provide a remanufactured toner cartridge assembly wherein the respective components replaced will be capable of more rapid heat dissipation during usage to reduce and eliminate any warping and/or distortion of the components which create the problems encountered.

Still another object is to provide a solution wherein current production parts can be modified, both during and after usage, with a minimum service and/or parts cost, while at the same time retaining the characteristics of a new part.

Yet, still another object of the invention is that while ozone is generated while the machine is operating, it will have minimal effect on any modified thin coated parts using a suitable material although there will be some decrease in resilience of said materials used.

BRIEF DESCRIPTION OF THE DRAWINGS

This invention, together with other objects, features, aspects, and advantages thereof, will be more clearly understood from the following description, and considered in conjunction with the accompanying drawings. From the Hewlett Packard Service Manual on the Hewlett Packard 33471 Laserjet printer.

COMPLETE DESCRIPTION OF THE PREFERRED EMBODIMENT

In the image formation system 10, it will be remembered that a laser printer requires the interaction of several different technologies, electronics, optics, electro-photographics, etc., to provide any page of quality printed output. Each process functions independently and is coordinated with each of the other respective processes. The image formation system is centered around a photo-sensitive/photo-receptor drum in six relatively independent cooperative stages, A—Cleaning, B—Conditioning, C—Writing, D—Developing, E—Transfer, and F—Fusing.

Figure 1:
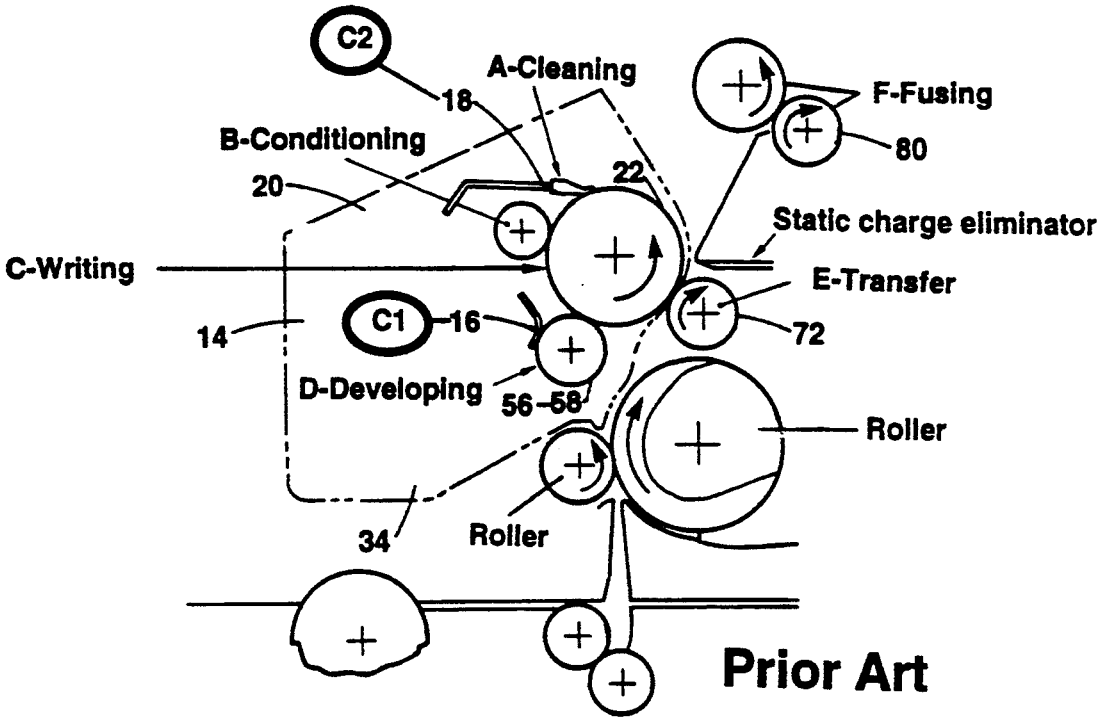
FIG. 1 illustrates prior art from with components C1 and C2 representing the modified structures.
Figure 2:
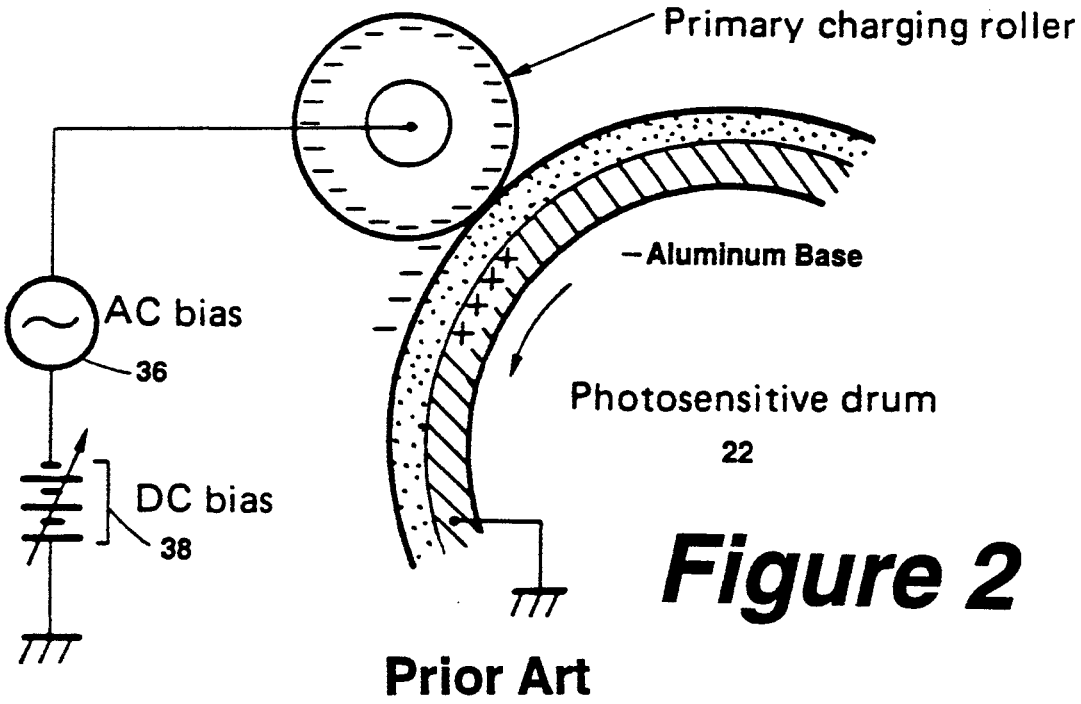
Figure 2 Prior Art
FIG. 2 illustrates the primary charging roller of the prior art.
Figure 3:
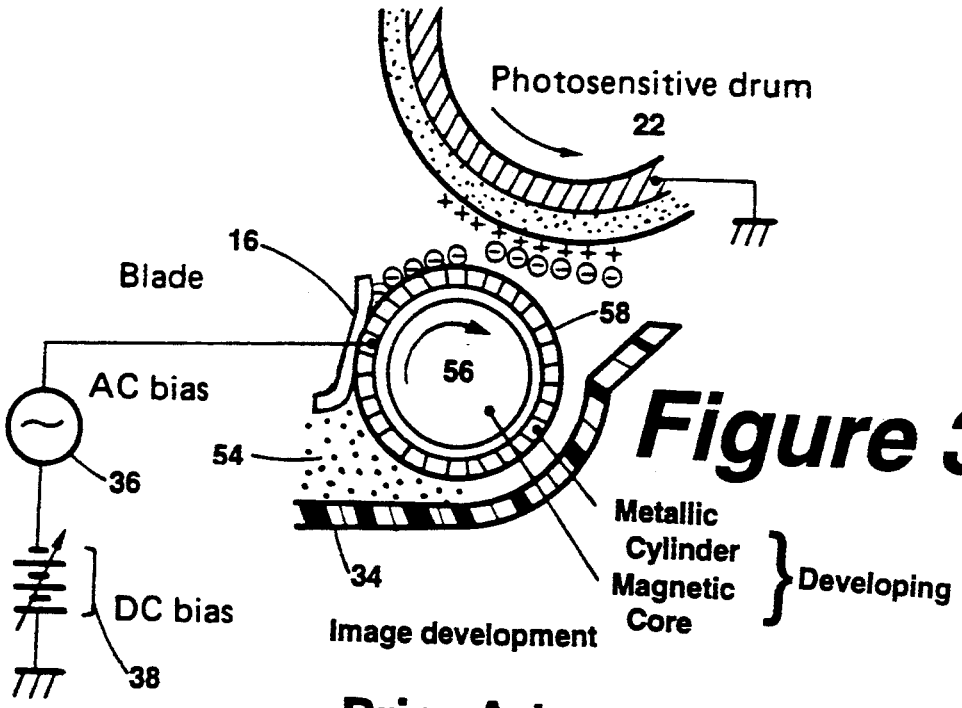
Figure 3 Prior Art
FIG. 3 is the development process from the prior art.
Figure 4:
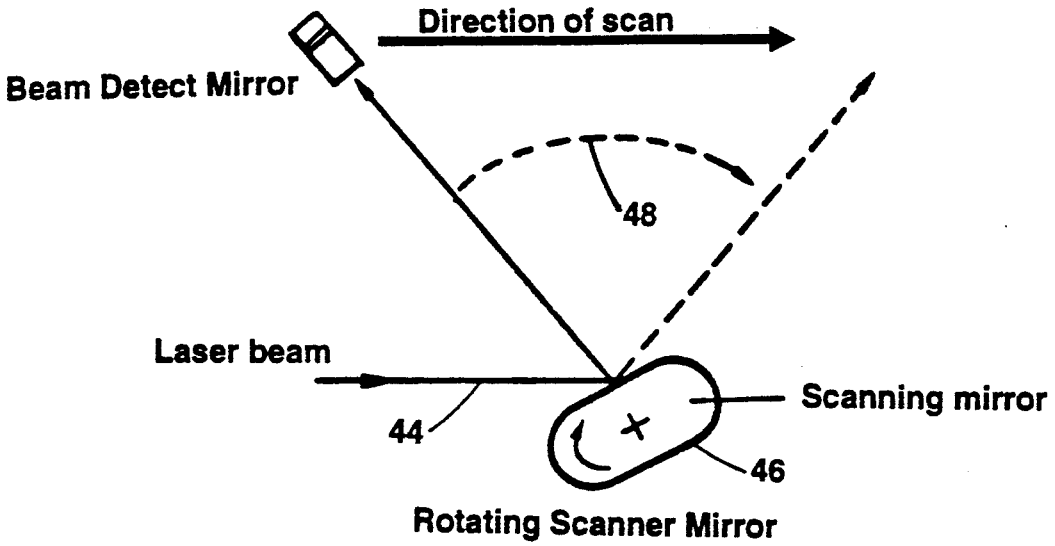
Prior Art Figure 4
FIG. 4 illustrates the rotating scanner mirror of the prior art.
Figure 5:
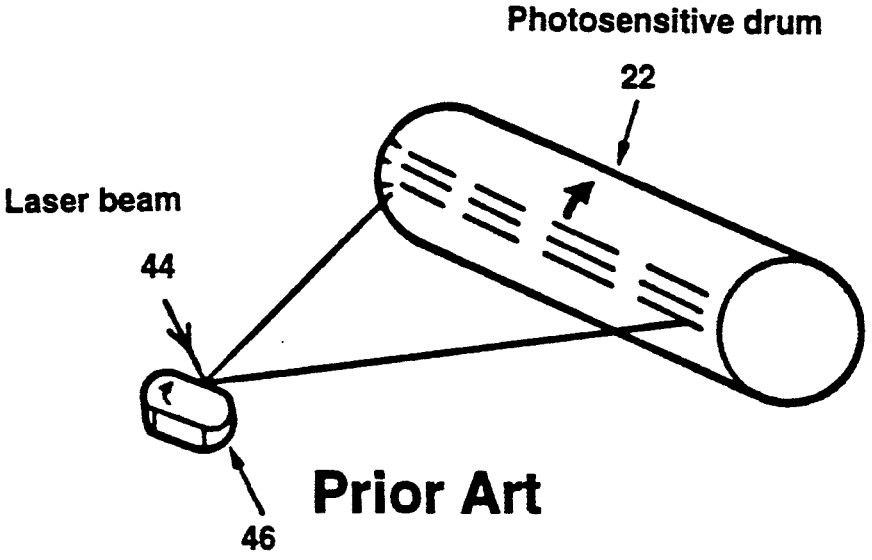
Prior Art Figure 5
FIG. 5 shows the photosensitive drum of the prior art.

Some of the processing stages are located in or immediately adjacent to the reusable cartridge 14, which is true of the spreader component #C-1, shown in FIG. 1 as 16, while the wiper component #C-2 is identified as 18, each of which will be modified in a similar manner. Since both the spreader 16 and wiper 18 are consumables, subject to wear and will degrade over both time as well as long and short term usage, which parts have been designed into and/or adjacent to the cartridge assembly 20. The cartridge assembly contains the photo-sensitive/photo-receptor drum 22, the primary charging roller 32, developer station 42, toner cavity 52, and the A—Cleaning station 62.

The photo-sensitive/photo-receptor drum 22 is the heart of the whole system, since it allows a selected image to be formed on the outer surface thereof and then transferred onto plain-paper. The drum 22 is formed from a cylinder that is coated with a layer of photo-conductive material, while the base of the photo-sensitive/photo-receptor drum 22 is connected to a ground potential. The material from which the drum 22 is made is photo-sensitive/photo-receptive and when exposed to light the negative charges deposited on said drum are conducted to the ground potential of the drum's base, while areas of the drum 22, which are not exposed to light, remain non-conductive and maintain their respective negative charge. However, it is very important not to expose the drum to bright sunlight or other source of bright light, since permanent damage to the drum can result.

It will also be noted that during the cleaning stage of the image formation, the photo-sensitive/photo-receptor drum's surface is prepared to hold an image by physically cleaning the said drum 22. During the printing process, the drum 22 is constantly rotating making several complete rotations per each printed page, before forming the image for a given section of print, any remaining toner from the previous rotation of the drum must be removed from the drum 22. The excess toner is removed using a rubber or other elastomeric wiper blade 18, after which the toner is collected and stored in the cleaner container and is prevented from leaking out of the cartridge 14 by the wiper blade 18.

After the drum 22 has been thoroughly cleaned, it must also be conditioned, which is accomplished by the application of a negative charge on the surface of said drum 22 by the primary charging roller 32 in the cartridge 14. The primary charging roller is coated with a conductive rubber that has an A-C bias 36 applied to erase any remaining residual charges to keep the potential on the photo-sensitive/photo-receptor drum 22 constant additionally a negative DC 38 voltage is applied by the charging roller 32 to create a uniform negative potential on the drum 22 surface, which is controlled by the print density adjustment slide.

With respect to the conventional corona charging system, the charging roller requires a lower charging voltage and this substantially decreases the amount of ozone generated by the operating printer, compared to using a corona wire.

After rotating past the conditioning station, the drum 22 will have a uniform negative potential on its surface. At the writing station C, 40, a rotating laser scanner beam 44 is used to discharge the potential to ground by focusing laser light onto pre-selected areas of the drum 22 which creates what is known as a latent elastostatic image, which is later developed into a visible image.

To explain how the laser light is controlled in order to achieve the resulting electrostatic image, laser light is produced by a small laser diode which is turned on and off by simply supplying or denying power. The direction of the laser diode is fixed. The beam 44 created thereby shines onto a rotating two sided mirror 46. As the mirror 46 rotates, the beam 44 reflects off of the mirror and sweeps (left to right) in an arcing motion.

The horizontal beam is brought into focus on the surface of rotating drum 22 by a set of focusing lenses, the beam reaches the said drum 22 through a laser beam access slot in the side of the cartridge 14. Because the beam 44 sweeps the total length of the drum 22, the total circumference of the drum can be covered. The sweeping action of the beam is similar to how a television sweeps its electron beam to form a video image on the screen. The speed of the scanner motor turns the two sided mirror 46 and the speed of the main motor that turns the drum are synchronized so that each successive sweep of the beam 44 is offset 1/300th of an inch. The beam can also be turned on and off to place a dot of light every 1/300th of an inch in a horizontal direction. This is how the printer functions to achieve its 300 dots per inch resolution.

At the start of each sweep before the beam reaches the drum 22, the beam is reflected off of the beam detect mirror into a fiber optics cable. Thus, as the momentary pulse of light is directed through the fiber optics cable to a DC controller where it is converted into an electric signal that is used to synchronize the output data for a single scan line sweep. This pulse will then be known as the beam detect signal, which will also be used to diagnose any problems with the laser and/or the scanner motor.

Following the writing station C, 40, the photo-sensitive/photo-receptor drum 22, the said drum will have an invisible latent electrostatic image thereon. Thus, the portions of the drum unexposed remain with a negative potential placed there by the primary charging roller, while the portions exposed to the light will have been discharged to ground, so as to form the latent electrostatic image thereon.

Therefore, at the developing station D, 42, the latent electrostatic image is converted into a visible image on the drum 22. The developing unit is in the form of a metallic cylinder 56 that rotates around a fixed magnetic core 58, disposed inside of the toner cavity 34, while a spreader blade 16 is disposed adjacent thereto. The toner in said cartridge is a black plastic resin 54 bound with iron particles. Thus, the iron in the toner 54 is attracted to the magnetic core 58 of the metallic cylinder. The spreader blade 16 controls and adjusts the quantity of toner 54 on the developing cylinder to provide a uniform deposit thickness. The toner particles receive a negative surface charge through a rubbing contact against the developing cylinder connected to a negative DC supply. The negative charge on the toner 54 creates an attraction between the toner and the grounded discharge areas of the photo-sensitive/photo-receptor drum 22 that have been subjected to the exposed laser light 44. This charge also causes the toner to be repelled from the negatively charged areas of the drum that have not been exposed to the laser light. An AC potential is also applied to the developing cylinder to decrease the attraction between the toner 54 and the magnetic core 56 of the metallic cylinder 58, and also to increase the repelling action of the toner 54 against the drum areas not exposed to the laser light. Thus, this AC potential functions to improve and control the density and contrast of the output pages.

The DC bias of the developing cylinder 58 can be adjusted to charge the force attraction between the toner 54 and the drum 22. Thus, with a change in the bias, the print density can be increased and/or decreased to have variations of approximately plus or minus ten (10%) percent.

The transfer station E, 70, is where the toner image on the drum 22 is transferred to the paper copy. A positive charge is applied to the back of the paper by the transfer roller causing the negatively charged toner 54 on the photo-sensitive/photo-receptor drum 22 surface to be attracted to the paper page. It will be noted that, this transfer process requires a lower transfer voltage, produces less ozone than the conventional "corona" method of transfer.

As the paper and drum 22 continue to move, the small radius of the drum 22 and the paper stiffness cause the paper to peel away from the drum 22. Separation is also aided when the static charge eliminator is grounded, so that the forces between the negatively charged drum 22 (and/or photo-sensitive/photo-receptor belt) and positively charged paper are diminished. Without this condition, the paper could wrap around the drum 22. As the said drum 22 rotates, the paper moves to the fusing station F, 80, while the drum 22 rotates through the cleaning and conditioning stations A and B respectively, ready to receive the next image to be copied.

Now, with respect to the drawings, FIGS. 1–13, are exceptionally simple although the proposed structures will provide the users of electrostatic copy machines many savings, both in operational costs as well as service calls. FIGS. 1 through 5 describe the functions and operational characteristics of this type of plain paper imaging device, while FIGS. 6 through 12 delineate how once a problem is recognized, it may be possible to find a simple, cost effective solution, which is the case in the present invention.

Figure 6:
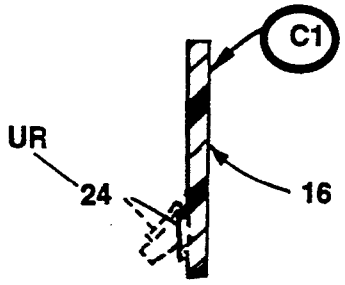
FIG. 6 is an enlarged elevational view of a modified spreader shown as component #1 in FIG. 1.
Figure 7:
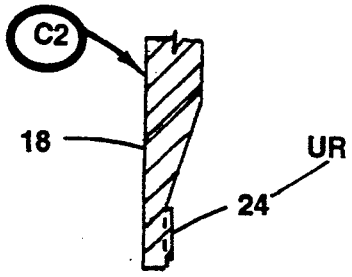
FIG. 7 is an enlarged elevational view of a modified wiper for the photosensitive drum.
Figure 8:
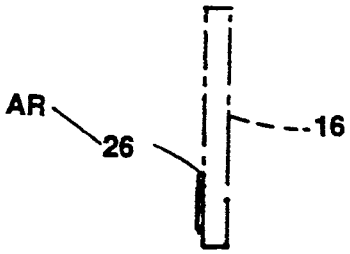
FIG. 8 is is a modified view of a unitary spreader construction (enlarged).
Figure 9:
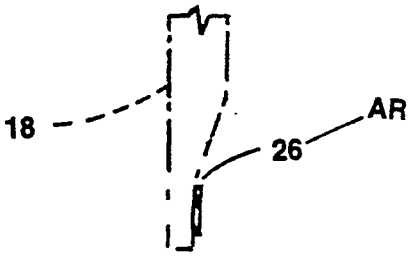
FIG. 9 is a modified view of a unitary wiper construction (enlarged).

In FIG. 6, we see a new unitary toner spreader blade 16 before assembly, wherein the said blade can be extruded, using any of several flexible plastics having both resilient as well as elastomeric properties. While these properties are not unusual, they do present a problem when wear and operational heat serve to allow the distortion of the said materials. To avoid such problems, the addition of a reinforcement adjacent to the surface nearest the friction-generated heat source provides the answer. This is true for each of the diagrammatic illustrations shown in the several FIGS. 6 through 12, which is a predetermined thickness and of sufficient width to eliminate any potential distortion of the blades 16, which is the spreader blade cross section shown in FIG. 1, while the same teaching is applied to the wiper blade 18, used to clean the photosensitive/photo-receptor blade 18, shown in FIG. 2. However, if we were to use blades for the same purpose of the original design provided by the manufacturer of the machine, we can modify them as shown in FIGS. 7 and 8, by the addition of an adhesively applied material across the edge of either of the blades 16 or 18 with the same results. To carry this a step further, we could do the same thing, using a strip of predetermined thickness reflective material by means of an adhesive reflective material applied in the same manner shown in FIGS. 7 and 8, while it would also be possible to mask-off and plate with a reflective material to enhance heat dissipation.

Figure 10:
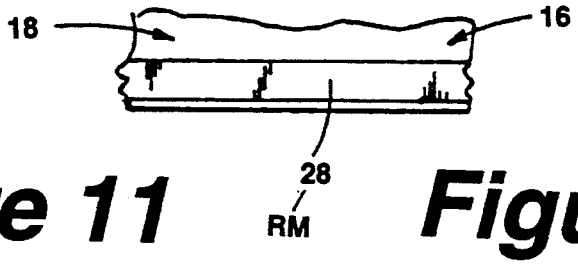
FIG. 10 is an illustration of an adhesively applied plastic reinforcement for either a spreader or wiper blade which could also be an aluminum heat reflective member.
Figure 11:
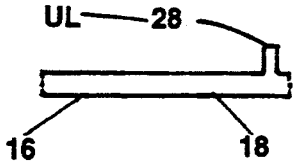
FIG. 11 is a drawing of a modified unitary spreader with an upstanding lip thereon.
Figure 12:
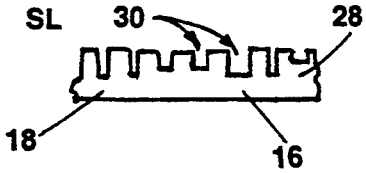
FIG. 12 is similar to FIG. 11 wherein said lip is segmented to increase the surface area exposed for faster heat dissipation.

In FIG. 10, we see a simple blade structure wherein an upstanding heat dissipating lip member thereon, and shown in elevation in FIG. 11. While the said lip is shown as being vertical to the blade and of generally rectangular cross section, it could be of many other configurations, without departing from the spirit or scope of the invention. The lip could also be provided with a series of linear slots, along with a definite height, width, and depth, to provide the desired characteristics, including any and all of the considerations delineated in the previous Figures.

Figure 13:
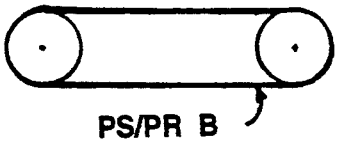
FIG. 13 shows a drawing having a pre-determined height, width and depth spaced fingers thereon the spacing of which would be variable for any particular heat generated hot spots therein.

In FIG. 13, we see a substitute for the photo-sensitive/photo-receptor drum 22, using a photo-sensitive/photo-receptor belt for the same purpose and operation in the same general manner as above described.

Figure 14:
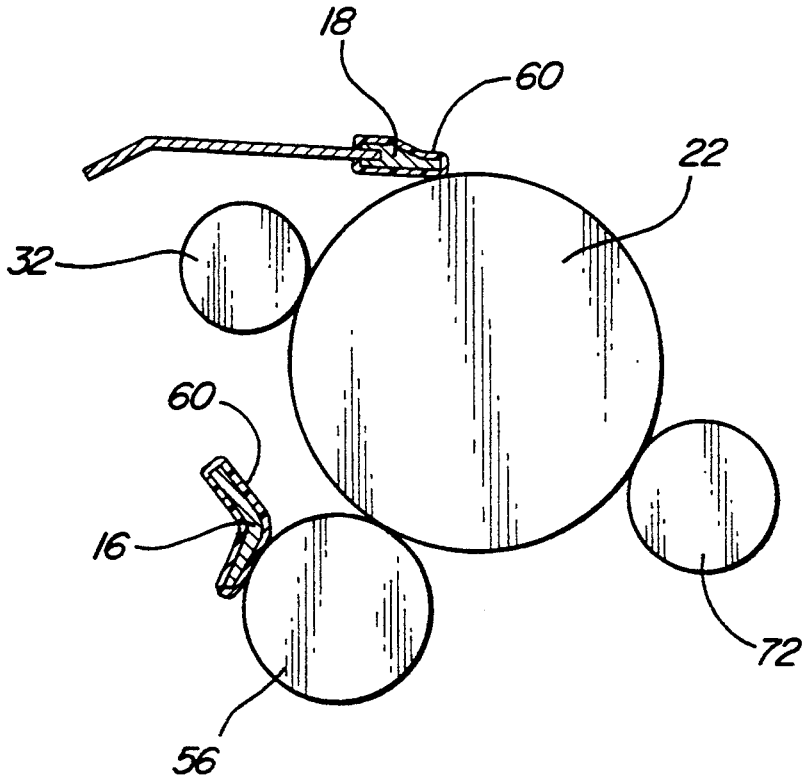
FIG. 14 is a partial view of the image formation system shown in FIG. 1 showing some surfaces provided with a conductive TEFLON coating.

FIG. 14 is a partial view of the image formation system shown in FIG. 1 with an improvement furnished by this invention. In commercially manufactured copiers, printers and facsimile machines, and in toner cartridge assemblies that are used in some of these machines, charge rollers are incorporated for charging the photo-sensitive/photo-receptor drum 22. Both the primary charge roller 32 and transfer charge roller 72 have a coating of conductive rubber.

A conductive polytetrafluoroethylene (TEFLON) coating 60 may be applied to the surface of the spreader blade 16 and wiper blade 18. The function of the TEFLON coating is to repel and minimize toner attachment to the blades and to slow the aging process of the spreader and wiper blades caused by exposure to ozone generated during operation of the copy, printing or facsimile machine. The TEFLON is made conductive by the addition of a conductive substance. The conductive TEFLON coating also acts as a lubricant and assists in the dissipation of heat from the spreader and wiper blades generated during their operation, reducing the potential of the blades to warp.

The TEFLON coating applied on the surfaces of the spreader and wiper blades is made conductive so it eliminates static elasticity, improving the performance of the machines. The conductive TEFLON coating also reflects heat. Using a conductive coating on the wiper blade may in turn eliminate the need for an erase lamp. If the wiper blade is properly grounded, it provides a charge path away from the drum. This allows the removal of any residual charge or image from the drum, a function otherwise performed by an erase lamp.

Since minor changes and modifications varied to fit particular operating requirements and environments will be understood by those skilled in the art, the invention is not considered limited to the specific examples chosen for purposes of illustration, and includes all changes and modifications which do not constitute a departure from the the spirit and scope of this invention as claimed in the following claims and reasonable equivalents to the claimed elements.

I claim:

1. In toner cartridge assemblies of copiers, printers and facsimile machines which incorporate a primary charge roller for charging a photo-sensitive/photo-receptor drum, a wiper blade for removing excess toner from said drum and a spreader blade for controlling and adjusting the quantity of toner on a developing cylinder utilized within said toner cartridge assembly, the invention comprising a conductive coating applied on a surface of said wiper blade in contact with said drum and on a surface of said spreader blade in contact with said developing cylinder, said conductive coating consisting of polytetrafluoroethylene made conductive by the addition of a conductive substance, whereby toner attachment to said blades is minimized and heat is dissipated to reduce warpage of said blades.

2. In toner cartridge assemblies of copiers, printers and facsimile machines which include a wiper blade for removing excess toner from a photo-sensitive/photo-receptor drum, the invention comprising a conductive coating applied on a surface of said wiper blade in contact with said drum, said conductive coating consisting of polytetrafluoroethylene made conductive by the addition of a conductive substance, whereby toner attachment to said blade is minimized and heat is dissipated to reduce warpage of said blade.

3. The invention as in claim 2 wherein said wiper blade is grounded, whereby said conductive coating enables said wiper blade to eliminate static electricity and the need for an erase lamp within said toner cartridge assemblies.

4. In toner cartridge assemblies of copiers, printers and facsimile machines which include a spreader blade for controlling and adjusting the quantity of toner on a developing cylinder utilized within said toner cartridge assemblies, the invention comprising a conductive coating applied on a surface of said spreader blade in contact with said developing cylinder, said conductive coating consisting of polytetrafluoroethylene made conductive by the addition of a conductive substance, whereby toner attachment to said blade is minimized and heat is dissipated to reduce warpage of said blade.

* * * * *